US012471664B2

(12) United States Patent
Kajiwara

(10) Patent No.: US 12,471,664 B2
(45) Date of Patent: Nov. 18, 2025

(54) SOLE STRUCTURE AND SHOE HAVING THE SAME

(71) Applicant: MIZUNO CORPORATION, Osaka (JP)

(72) Inventor: Yo Kajiwara, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 18/614,680

(22) Filed: Mar. 24, 2024

(65) Prior Publication Data

US 2024/0324719 A1 Oct. 3, 2024

(30) Foreign Application Priority Data

Mar. 30, 2023 (JP) ..... 2023-055245

(51) Int. Cl.
*A43B 13/12* (2006.01)
*A43B 13/14* (2006.01)

(52) U.S. Cl.
CPC ..... *A43B 13/125* (2013.01); *A43B 13/122* (2013.01); *A43B 13/146* (2013.01)

(58) Field of Classification Search
None
See application file for complete search history.

(56) References Cited

U.S. PATENT DOCUMENTS

| | | | | |
|---|---|---|---|---|
| 7,082,702 | B2 * | 8/2006 | Cretinon | A43B 13/026 36/76 R |
| 10,271,614 | B2 * | 4/2019 | Huard | A43B 13/026 |
| 10,925,346 | B2 * | 2/2021 | Holmes | A43B 13/226 |
| 11,553,755 | B2 * | 1/2023 | Yahata | A43B 7/146 |
| 11,896,081 | B2 * | 2/2024 | Avar | A43B 13/226 |
| 2011/0252671 | A1 * | 10/2011 | Maron | A43B 13/141 36/31 |
| 2017/0105480 | A1 * | 4/2017 | Hurd | A43B 13/145 |
| 2019/0150563 | A1 | 5/2019 | Shorten | |
| 2022/0031016 | A1 | 2/2022 | Geis et al. | |
| 2022/0053878 | A1 | 2/2022 | Geis et al. | |

FOREIGN PATENT DOCUMENTS

| | | | |
|---|---|---|---|
| EP | 2979568 | A1 | 2/2016 |
| JP | 2022-521032 | A | 4/2022 |
| JP | 2022103359 | A | 7/2022 |
| WO | 2014155511 | A1 | 10/2014 |

OTHER PUBLICATIONS

Office Action dated Jan. 27, 2025 in corresponding Japanese Patent Application No. 2023-055245, with Machine Translation.

* cited by examiner

*Primary Examiner* — Jila M Mohandesi
(74) *Attorney, Agent, or Firm* — Renner, Otto, Boisselle & Sklar, LLP

(57) ABSTRACT

The present disclosure ensures the rigidity of a sole structure without loss of the bendability of the sole structure. A sole structure includes a plate that is arranged between an outsole and a midsole and is made of a material having higher rigidity than the outsole and the midsole. The plate has a plurality of cuts and a plurality of movable portions (movable portions) defined by phantom lines running along extending directions of the cuts. The movable portions are configured to be movable independently of each other in a thickness direction of the sole structure.

16 Claims, 15 Drawing Sheets

SOLE STRUCTURE AND SHOE HAVING THE SAME

CROSS-REFERENCE TO RELATED APPLICATION

This application claims priority to Japanese Patent Application No. 2023-055245 filed on Mar. 30, 2023, the entire disclosure of which is incorporated by reference herein.

BACKGROUND

The present disclosure relates to a sole structure and a shoe having the sole structure.

As a sole structure that is usable for, for example, trail running, one shown in Japanese Unexamined Patent Publication No. 2022-521032 is known.

Japanese Unexamined Patent Publication No. 2022-521032 discloses a sole structure including an outsole (an outsole 7), a midsole (a comfort sole 9) arranged on an upper side of the outsole, and a plate (a shell 13) arranged on an upper side of the midsole. The plate may be made of plastic or a composite material. The plate is arranged in the sole structure to extend from a position corresponding to a tiptoe of a foot of a wearer to a position corresponding to a heel of the foot of the wearer.

SUMMARY

The sole structure of Japanese Unexamined Patent Publication No. 2022-521032 has rigidity improved by the plate made of plastic or a composite material. This can stably support the feet of a person wearing shoes including the sole structure (hereinafter referred to as a "wearer"). Further, when the foot of the wearer touches the ground or a rough road surface (hereinafter referred to as the "ground or any other surface"), the rigidity of the plate in the sole structure can reduce an impact pushing up the foot when, for example, the wearer steps on a stone on the ground or any other surface.

Although the rigidity improves, the sole structure having the plate tends to decrease in bendability. Consequently, the sole structure restricts the movements of joints of the wearer's foot more than necessary and possibly makes the movements of the foot less flexible. In particular, for a competitive sport involving walking or running on the ground or any other surface (e.g., trail running), the less flexible movements of the wearer's foot increase a load on the joints of the foot. During the trail running that takes relatively long race time, the load is kept applied to the joints for a long time and may possibly hurt the foot of the wearer.

For the higher bendability of the sole structure, for example, the plate can be removed from the sole structure of Japanese Unexamined Patent Publication No. 2022-521032. However, the sole structure without the plate cannot provide the rigidity required for the sole structure. This makes stable support of the wearer's foot difficult. Even if the sole structure without the plate has a sufficiently thick midsole, it is difficult to reduce the impact pushing up the foot when the foot touches the ground.

In view of the foregoing background, an object of the present disclosure is to ensure the rigidity of the sole structure without loss of the bendability of the sole structure.

In order to achieve the object, a first aspect of the disclosure relates to a sole structure of a shoe. The sole structure includes an outsole, a midsole stacked on an upper side of the outsole, and a plate that is arranged between the outsole and the midsole and is made of a material having a higher rigidity than the outsole and the midsole. The plate includes a plurality of cuts formed to extend from a peripheral edge of the plate in a first direction or a second direction intersecting with the first direction and a plurality of movable portions defined by phantom lines running along extending directions of the cuts. The movable portions are configured to be movable independently of each other in a thickness direction of the sole structure.

In the first aspect, the plate arranged between the outsole and the midsole improves the rigidity of the sole structure. This can stably support the wearer's foot. The rigidity of the plate can reduce an impact pushing up the foot when the foot touches the ground.

The cuts formed in the plate lower the rigidity of the plate locally at the phantom lines running along the extending directions of the cuts. Thus, the plate easily bends along the phantom lines. For example, when the impact pushing up the foot (an external pressure in the vertical direction) is applied to any of the movable portions, the plate bends along the phantom lines defining the movable portion.

The movable portions are configured to be movable independently of each other in the thickness direction of the sole structure. This configuration avoids loss of the bendability of the sole structure. Thus, the movements of joints of the foot of the wearer are less likely to be restricted, allowing each of the movable portions to follow the flexible movements of the foot of the wearer. This reduces a load applied to the joints of the wearer's foot during, for example, trail running that takes relatively long race time, keeping the wearer's foot from hurting. Further, this configuration ensures that the movable portions have the same rigidity as the plate, allowing the movable portions to reduce the impact pushing up the foot when the foot touches the ground.

Thus, in the first aspect, the rigidity of the sole structure can be ensured without loss of the bendability of the sole structure.

A second aspect of the present disclosure is an embodiment of the first aspect. In the second aspect, the cuts include at least one first cut extending in a first direction and at least one second cut extending in a second direction.

In the second aspect, the movable portions can be subdivided. This can further enhance the ability of the sole structure to follow the flexible movements of the foot of the wearer.

A third aspect of the present disclosure is an embodiment of the first aspect. In the third aspect, the midsole has a plurality of grooves formed in an upper surface of the midsole. Each of the grooves extends along the first direction or the second direction.

In the third aspect, the midsole can bend in accordance with the movements of the movable portions. This can avoid loss of the bendability of the sole structure.

A fourth aspect of the present disclosure is an embodiment of the third aspect. In the fourth aspect, the grooves include at least one first groove extending in the first direction and at least one second groove extending in the second direction.

In the fourth aspect, the midsole easily bends in accordance with the movements of the movable portions. This can avoid loss of the bendability of the sole structure.

A fifth aspect of the present disclosure is an embodiment of the first aspect. In the fifth aspect, the first direction corresponds to a foot width direction of the sole structure, and the second direction corresponds to a foot length direction of the sole structure.

In the fifth aspect, the sole structure can bend in the foot width direction and the foot length direction.

A sixth aspect of the present disclosure is an embodiment of the first aspect. In the sixth aspect, the outsole includes an outsole body and a plurality of projections projecting downward from the outsole body. Each of the movable portions is arranged to overlap with any of the projections in a thickness direction of the sole structure.

In the sixth aspect, the projections do not interfere with the movements of the movable portions and can give improved traction to the outsole.

A seventh aspect of the present disclosure is an embodiment of the sixth aspect. In the seventh aspect, the cuts include at least one first cut extending in a first direction and at least one second cut extending in a second direction. The first direction corresponds to a foot width direction of the sole structure, the second direction corresponds to a foot length direction of the sole structure. Each of the projections is arranged not to overlap with the first cut in a bottom view.

In the seventh aspect, loss of bendability of the sole structure can be avoided.

An eighth aspect of the present disclosure is an embodiment of the first aspect. In the eighth aspect, the plate is arranged in an area of the sole structure extending from a position configured to correspond to a tiptoe of a wearer's foot to a position configured to correspond to a center of an arch of the wearer's foot.

In the eighth aspect, the rigidity of the sole structure can be ensured without loss of bendability in the area of the sole structure extending from the position configured to correspond to the tiptoe of the wearer's foot to the position configured to correspond to the center of the arch of the wearer's foot.

A ninth aspect of the present disclosure is an embodiment of the first aspect. In the ninth aspect, the grooves are arranged in an area of the midsole extending from a position corresponding to a tiptoe of a wearer's foot to a position corresponding to a center of an arch of the wearer's foot.

In the ninth aspect, loss of the bendability of the sole structure can be avoided in the area of the sole structure extending from the position corresponding to the tiptoe of the wearer's foot to the position corresponding to the center of the arch of the wearer's foot.

A tenth aspect of the present disclosure is directed to a shoe including the sole structure of any one of the first to ninth aspects.

In the tenth aspect, shoes having advantages similar to those of the first to ninth aspects can be obtained.

As can be seen from the foregoing description, the present disclosure can provide a sole structure with rigidity without loss of bendability.

DETAILED DESCRIPTION

Embodiments of the present disclosure will be described in detail below with reference to the drawings. The following description of the embodiments is merely exemplary in nature, and is not intended to limit the scope, applications, or use of the present disclosure.

(Sole Structure)

Figure 1:
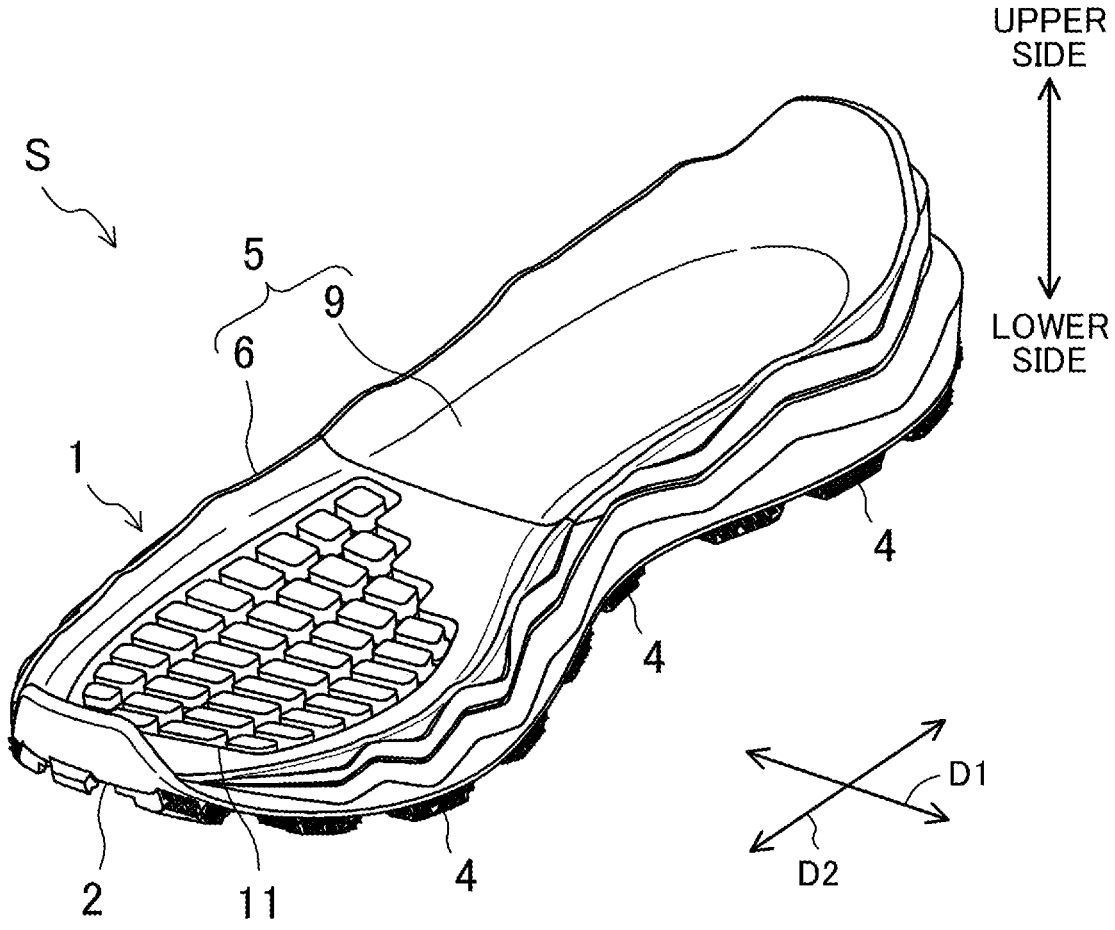
FIG. 1 is a perspective view of a sole structure of an embodiment of the present disclosure as viewed from above.

FIG. 1 shows an entire sole structure 1 of an embodiment of the present invention. A shoe S including the sole structure 1 with an upper 10 (see FIGS. 5 and 6) and other parts is mainly usable for trail running that involves walking or running on the ground or a rough road surface (will be hereinafter referred to as "ground or any other surface"). The shoe S including the sole structure 1 can also be used for ball games or various competitive sports played on soil or grass. The "ground" includes a sandy area, a grassy area, a rocky area, and a marshy area.

In the embodiments of the present disclosure, the sole structure 1 is for a right foot alone. A sole structure for a left foot is configured to be symmetrical to the sole structure for the right foot. In the following description, only the sole structure for the right foot will be described, and no description is made on the sole structure for the left foot.

In the following description, the terms "upper side" and "lower side" shown in the drawings represent a positional relationship in a thickness direction (vertical direction) of the sole structure 1. The terms "medial side" and "lateral side" shown in the drawings represent a positional relationship in a foot width direction of the sole structure 1. In the following description, a "first direction D1" corresponds to the foot width direction of the sole structure 1, and a "second direction D2" corresponds to a foot length direction of the sole structure 1.

Figure 3:
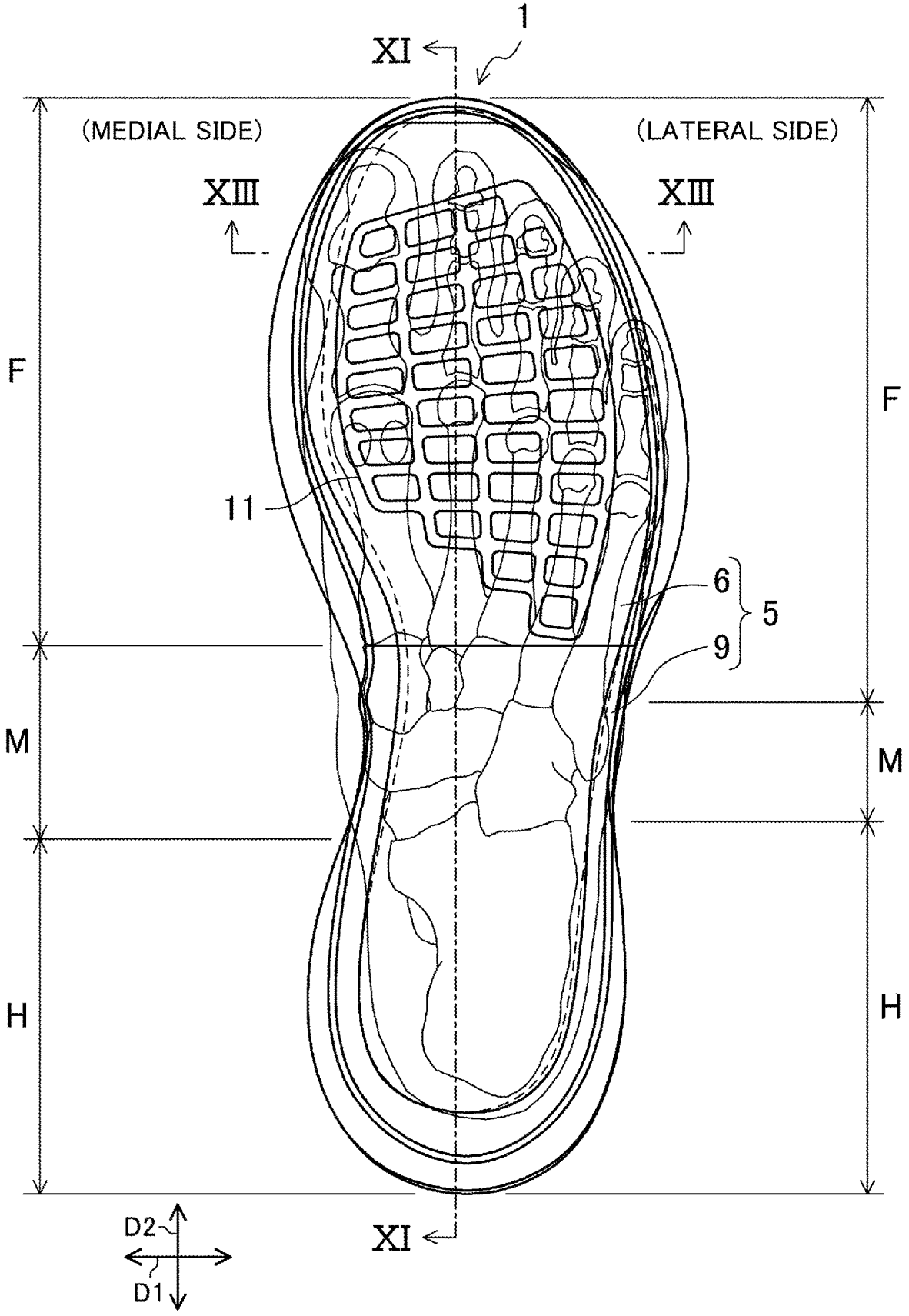
FIG. 3 is a plan view of the sole structure shown in FIG. 1, viewed from above, together with a skeletal structure of a wearer's foot.
Figure 4:
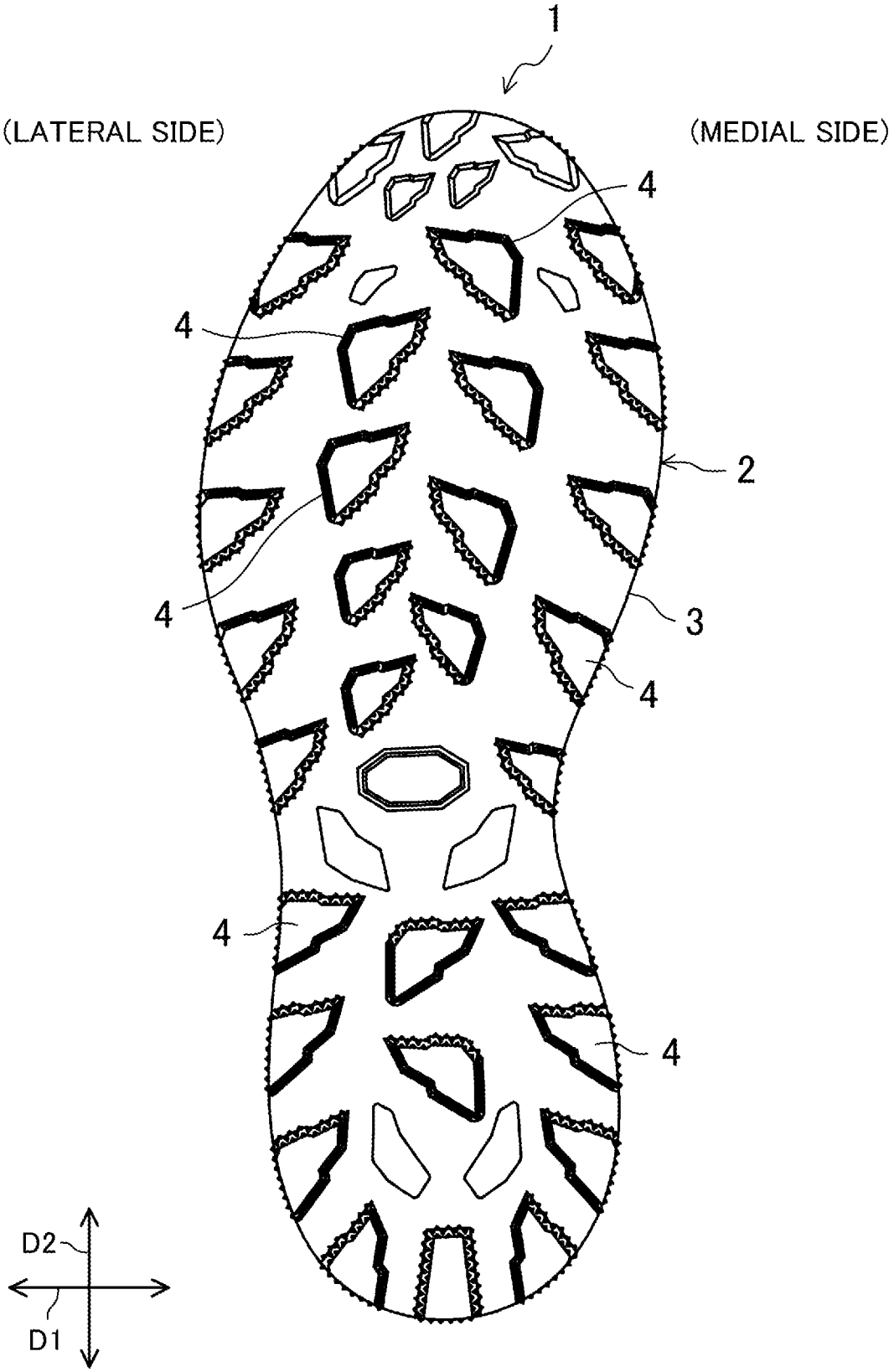
FIG. 4 is a bottom view of the sole structure shown in FIG. 1.
Figure 5:
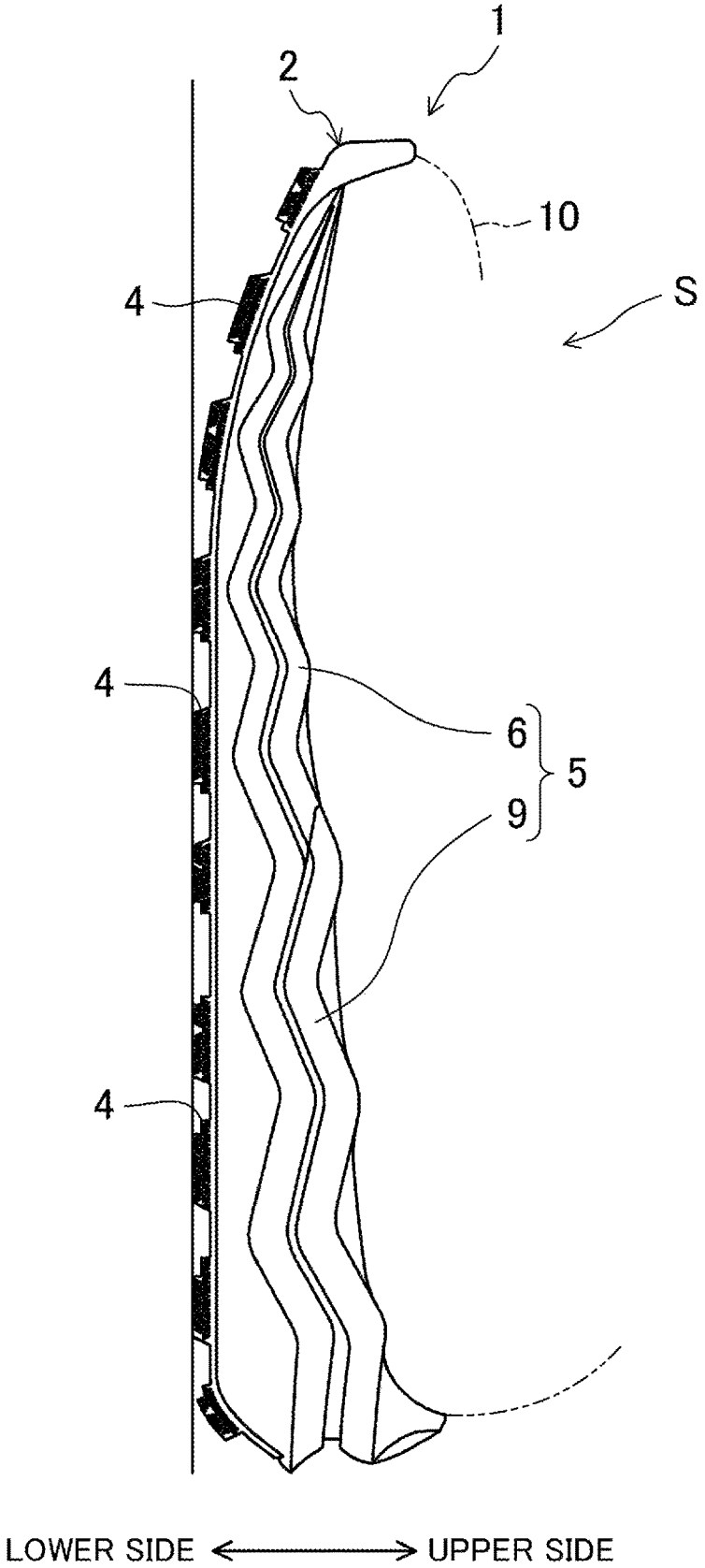
FIG. 5 is a side view of the sole structure shown in FIG. 1 as viewed from the medial side.
Figure 6:
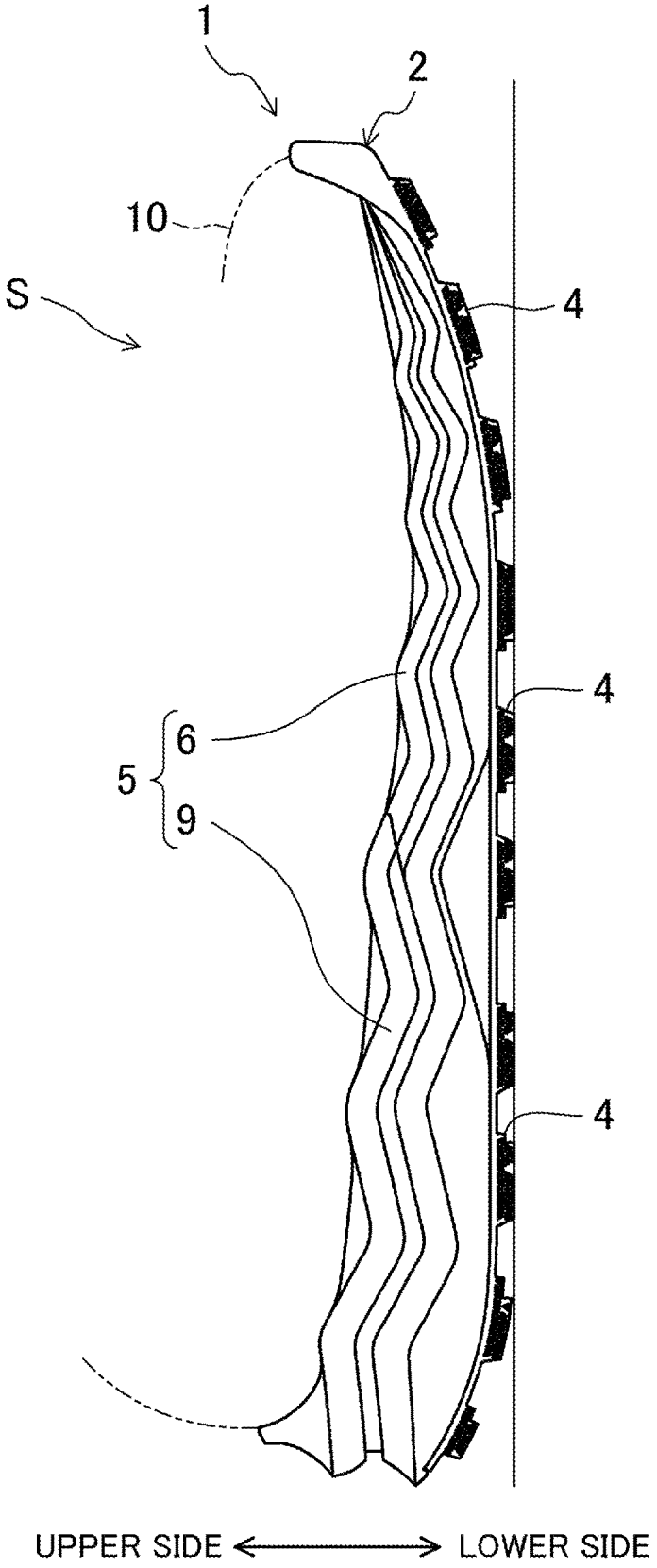
FIG. 6 is a side view of the sole structure shown in FIG. 1 as viewed from the lateral side.
Figure 7:
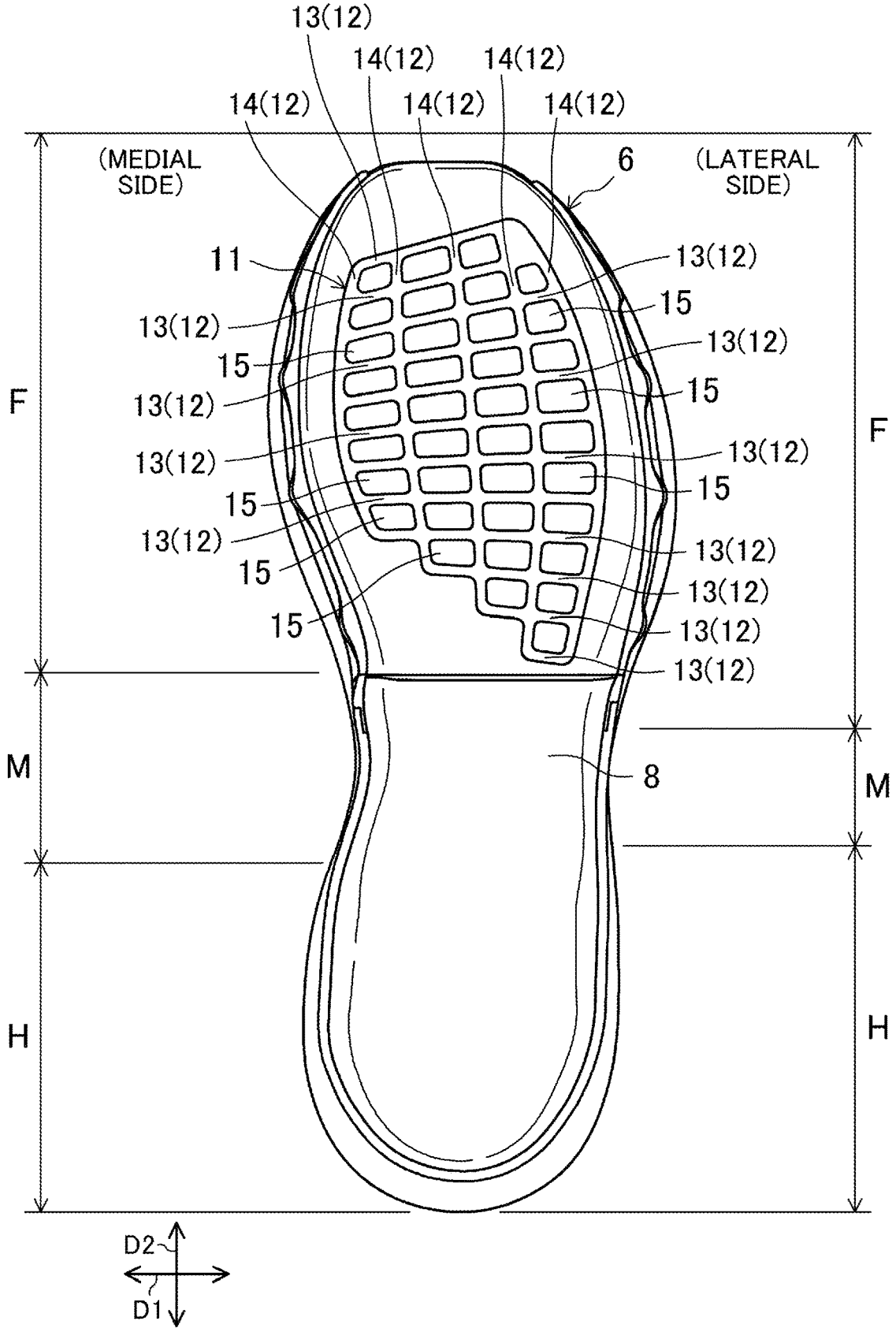
FIG. 7 is a plan view of a first midsole.

Further, as shown in FIGS. 3 and 7, a reference sign F indicates an area of the sole structure 1 corresponding to the forefoot of the wearer's foot, a reference sign M indicates an area corresponding to the midfoot of the wearer's foot, and a reference sign H indicates an area corresponding to the hindfoot of the wearer's foot. In FIGS. 4 to 6, the reference signs F, M, and H are not shown to simplify the drawings.

As shown in FIGS. 1 to 6, the sole structure 1 includes an outsole 2 and a midsole 5.

(Outsole)

Figure 11:
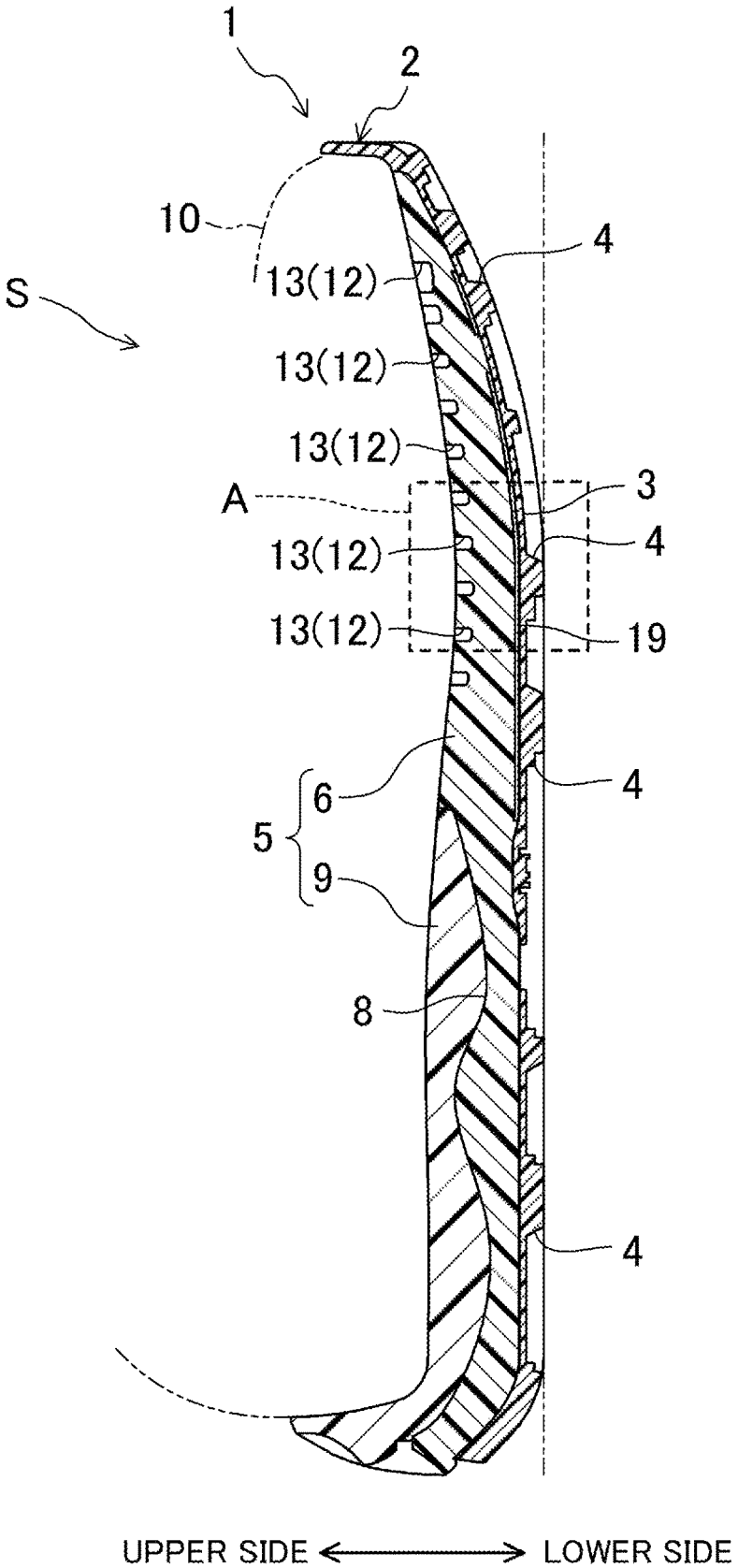
FIG. 11 is a cross-sectional view taken along line XI-XI shown in FIG. 3.
Figure 12:
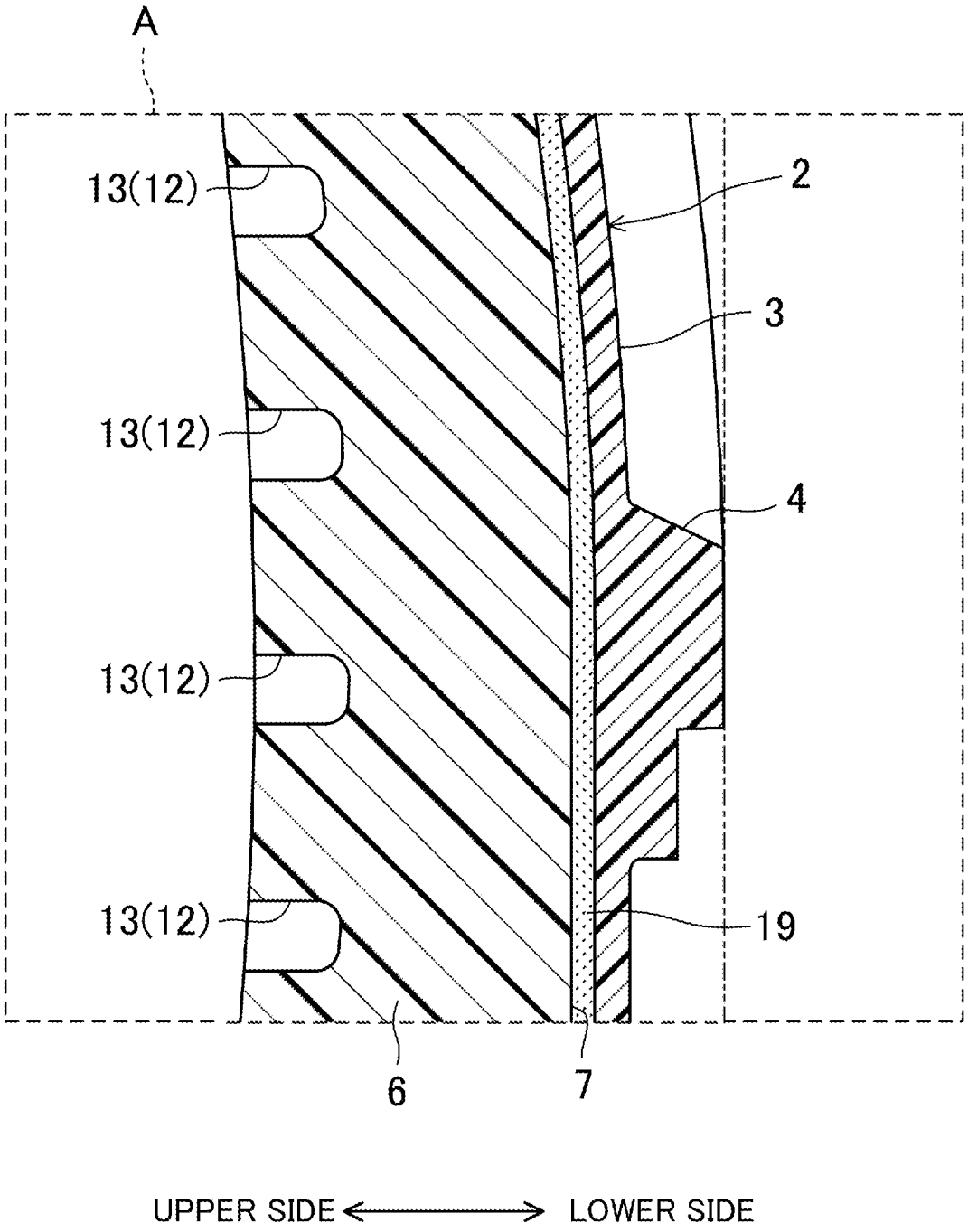
FIG. 12 is an enlarged view of part A shown in FIG. 11.

As shown in FIGS. 4 to 6, the outsole 2 is arranged in the sole structure 1 to correspond to the wearer's foot ranging from the forefoot F to hindfoot H. As shown in FIG. 11, the outsole 2 is stacked on a lower side of the midsole 5.

The outsole 2 is made of a hard elastic material harder than the midsole 5. Specific examples of the material of the outsole 2 include thermoplastic synthetic resins such as an ethylene-vinyl acetate copolymer (EVA), thermosetting resins such as polyurethane (PU), rubber such as butadiene rubber and chloroprene rubber, and foam materials obtained by foaming these materials. The outsole 2 preferably has a hardness of, for example, 50 A to 80 A (more preferably 60 A to 70 A) measured by a durometer C or A.

Figure 2:
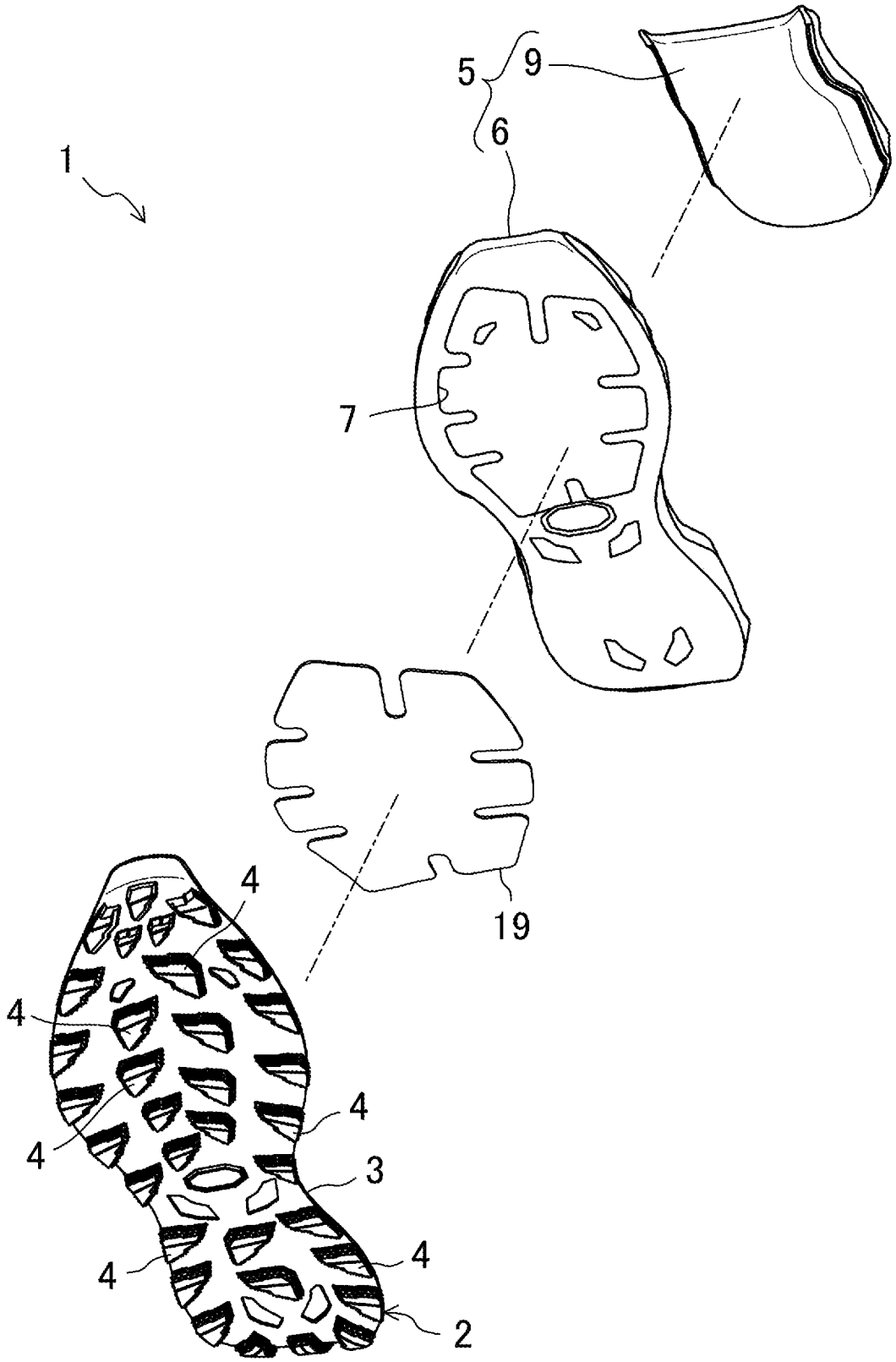
FIG. 2 is an exploded perspective view of the sole structure as viewed from below.

As shown in FIGS. 2 and 4, the outsole 2 includes an outsole body 3. The outsole body 3 has a substantially plate shape. As shown in FIGS. 11 to 14, the outsole body 3 is stacked on the lower side of the midsole 5 (specifically, a first midsole 6 described later). The outsole 2 has a plurality of projections 4 as shown in FIGS. 2 and 4. The projections 4 are arranged at intervals in a surface direction of a lower surface of the outsole body 3.

Each of the projections 4 projects downward from the lower surface of the outsole body 3 as shown in FIGS. 11 to 14. A lower surface of each projection 4 is configured as a contact surface that can be in contact with the ground or any other surface.

(Midsole)

The midsole 5 is stacked on an upper side of the outsole 2 (see FIG. 11). The midsole 5 is provided with the upper 10 (FIGS. 5 and 6) that covers the foot of the wearer.

The midsole 5 is made of a soft elastic material which is less rigid than the outsole 2. Specific examples of the material of the midsole 5 include thermoplastic synthetic resins such as an ethylene-vinyl acetate copolymer (EVA) and foams thereof, thermosetting resins such as polyurethane (PU) and foams thereof, and rubbers such as butadiene rubber and chloroprene rubber and foams thereof. The midsole 5 preferably has a hardness of, for example, 15 C to 65 C on the Asker C scale.

As shown in FIGS. 1 to 3, the midsole 5 includes a first midsole 6 and a second midsole 9. The first midsole 6 and the second midsole 9 may be made of the same soft elastic material or different soft elastic materials.

The first midsole 6 is arranged in the sole structure 1 to correspond to the wearer's foot ranging from the forefoot F to hindfoot H. The first midsole 6 is stacked on the upper side of the outsole 2 (see FIGS. 11 to 14). A lower surface of the first midsole 6 faces the upper surface of the outsole 2 (the upper surface of the outsole body 3).

As shown in FIG. 2, the lower surface of the first midsole 6 has a lower receiving part 7 for receiving a plate 19 which will be described later. The lower receiving part 7 has substantially the same shape as the outer shape of the plate 19 (see FIG. 9) in a bottom view. The lower receiving part 7 is formed in the lower surface of the first midsole 6 to correspond to the forefoot F and midfoot M of the wearer's foot in the bottom view. The lower receiving part 7 is recessed upward from the lower surface of the first midsole 6.

As shown in FIG. 7, an upper receiving part 8 for receiving the second midsole 9 is formed in an upper surface of the first midsole 6. The upper receiving part 8 has substantially the same shape as the outer shape of the second midsole 9 in a plan view. The upper receiving part 8 is formed in the upper surface of the first midsole 6 to correspond to the midfoot M and hindfoot H of the wearer's foot in the plan view. The upper receiving part 8 is recessed downward from the upper surface of the first midsole 6 (see FIG. 11).

As shown in FIGS. 5 and 6, the second midsole 9 is stacked on the upper side of on the first midsole 6. Specifically, as shown in FIG. 11, the second midsole 9 is placed in the upper receiving part 8 of the first midsole 6 and fixed to the upper receiving part 8 with an adhesive.

The upper surface of the first midsole 6 and the upper surface of the second midsole 9 serve as a planta support surface for supporting the planta of the wearer's foot. The planta support surface may be configured to directly support the planta of the wearer's foot or indirectly support the planta of the wearer's foot via an insole (not shown).

(Bending Region)

Figure 8:
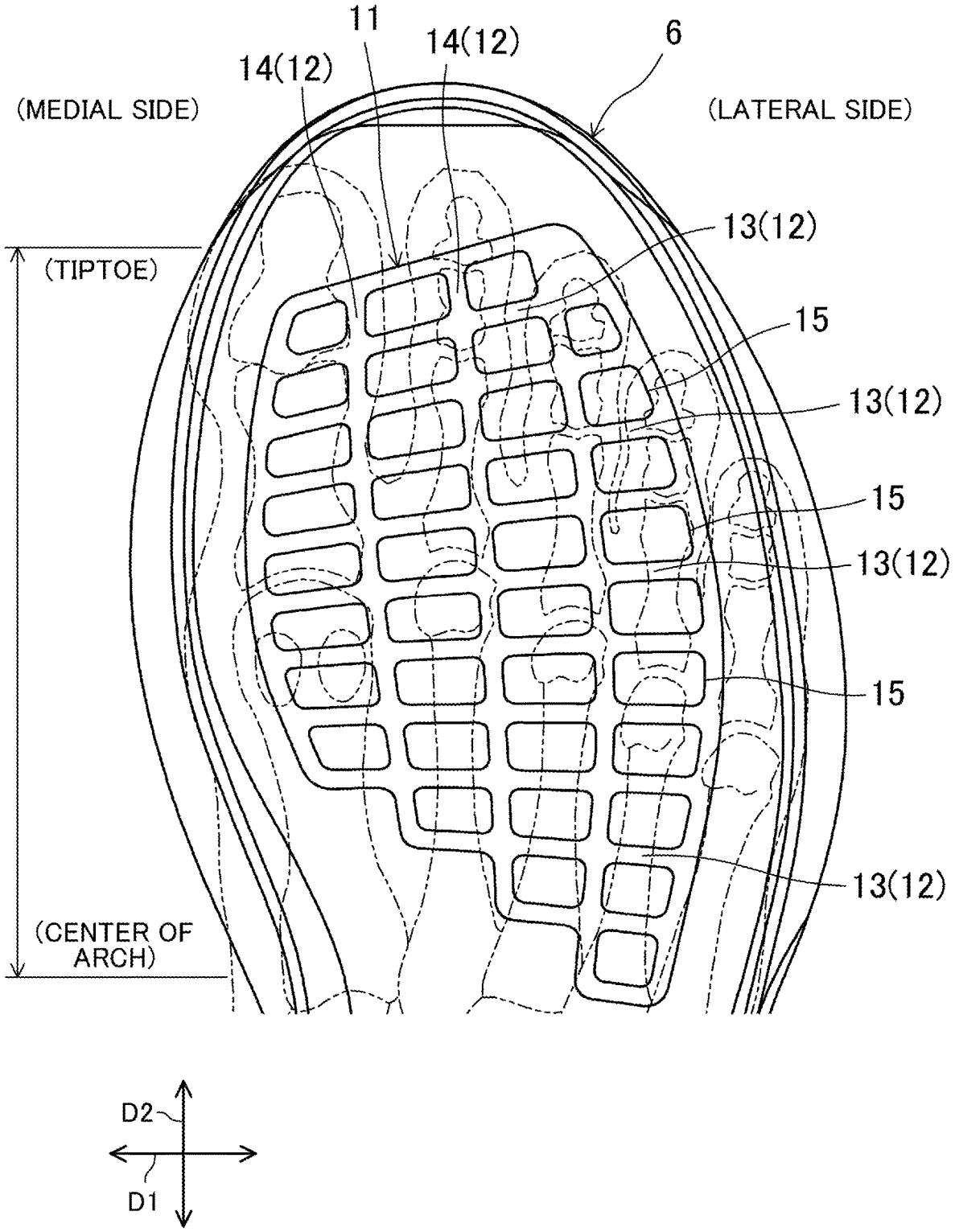
FIG. 8 is a partially enlarged view of part of the first midsole corresponding to the forefoot and midfoot of the wearer's foot, as viewed from above, together with the skeletal structure of the wearer's foot.

As shown in FIG. 1, the midsole 5 has a bending region 11. Specifically, as shown in FIGS. 7 and 8, the bending region 11 is provided on the upper side of the first midsole 6. The bending region 11 is arranged in the midsole 5 to correspond to the forefoot F and midfoot M of the wearer's foot. Specifically, the bending region 11 is arranged in an area of the midsole 5 extending from a position corresponding to the tiptoe of the wearer's foot to a position corresponding to the center of the arch of the wearer's foot (see FIG. 8).

(Grooves)

As shown in FIGS. 7 and 8, the midsole 5 has a plurality of grooves 12. The grooves 12 are arranged in the bending region 11 of the midsole 5. Each groove 12 is formed as a bottomed recess extending downward from the upper surface of the first midsole 6 (see FIGS. 11 to 13). That is, part of the first midsole 6 at the bottom of each groove 12 is relatively thin in a cross-sectional view. Thus, the part at the bottom of each groove 12 easily bends.

The grooves 12 include a plurality of first grooves 13 and a plurality of second grooves 14. Each of the first grooves 13 extends in the first direction D1. Specifically, each of the first grooves 13 extends substantially in the same direction as first cuts 21*a* to 21*e* described later. Each of the second grooves 14 extends in the second direction D2. Specifically, each of the second grooves 14 extends substantially in the same direction as second cuts 22*a* and 22*b* described later.

In the bending region 11, a protrusion 15 is surrounded by each adjacent pair of the first grooves 13, 13 and each adjacent pair of the second grooves 14, 14. The protrusion 15 has a substantially quadrangular shape in a plan view. The protrusion 15 protrudes upward from the bottom of the groove 12 (see FIGS. 11 and 12). An upper surface of each of the protrusions 15 is substantially flush with the upper surface of the midsole 5 (the planta support surface).

The protrusions 15 are formed integrally with the first midsole 6 and are made of the same soft elastic material as the first midsole 6. That is, the protrusions 15 are elastically deformable.

For example, when the wearer's foot steps on a stone on the ground or any other surface upon touching the ground or any other surface (hereinafter referred to as "when touching the ground"), the sole structure 1 is pushed up (hereinafter referred to as "push-up"). At this time, the part of the bending region 11 (first midsole 6) at the bottom of each groove 12 bends, and the adjacent protrusions 15, 15 approach or separate from each other. Thus, the bending region 11 improves the bendability of the sole structure 1 when the foot touches the ground.

Further, when the foot touches the ground and is pushed up, each of the protrusions 15, sandwiched between the ground and the planta surface of the wearer, is likely to receive a pressure in the vertical direction. At this time, each of the protrusions 15 elastically deforms toward the groove 12 so that the wall surfaces of the adjacent protrusions 15, 15 approach each other. Such elastic deformation of the protrusions 15 can reduce the impact pushing up the foot when the foot touches the ground in the forefoot F and midfoot M of the foot of the wearer. That is, the bending region 11 of the midsole 5 improves cushioning properties of the sole structure 1.

(Plate)

Figure 9:
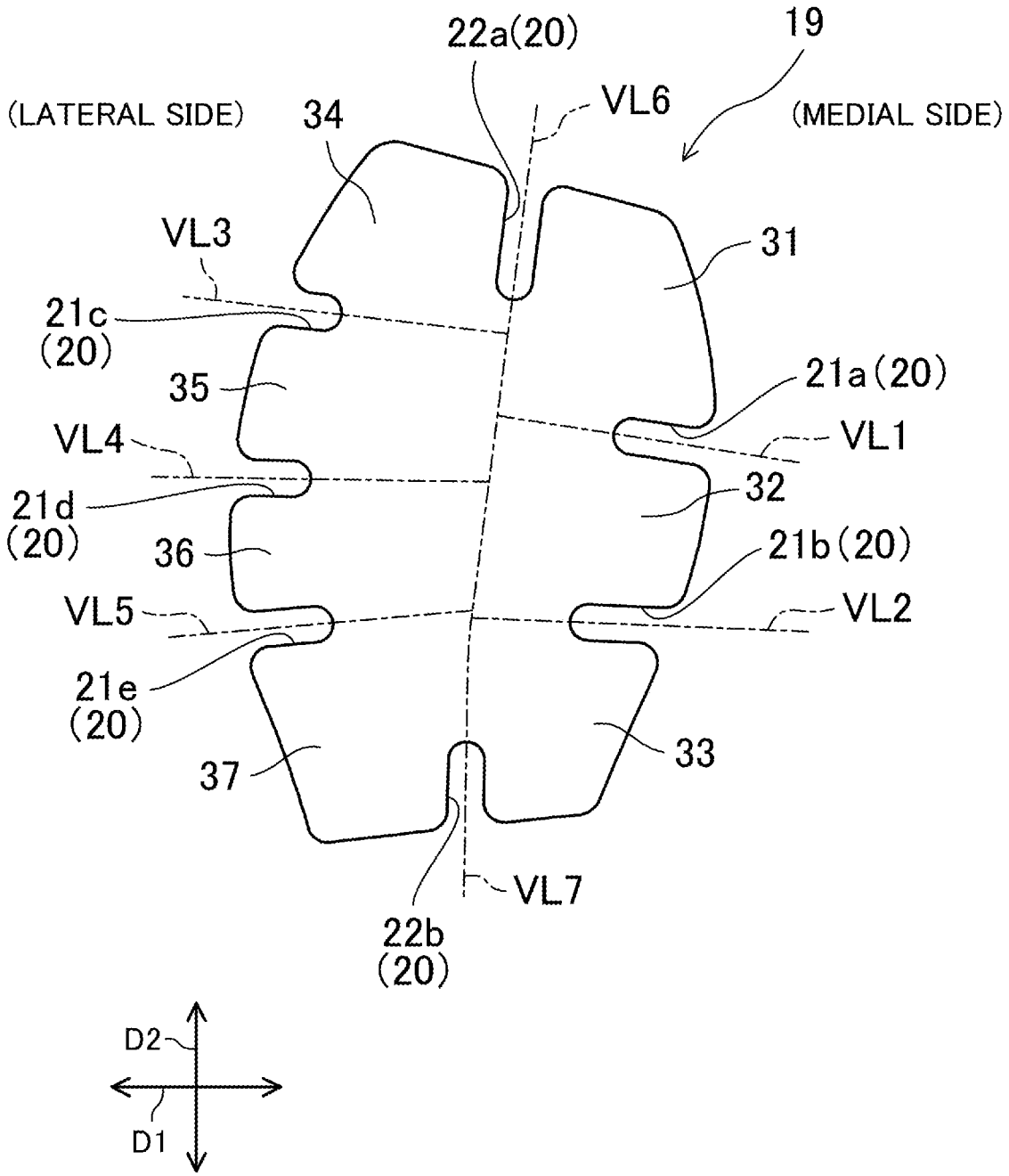
FIG. 9 is a bottom view of a plate.
Figure 10:
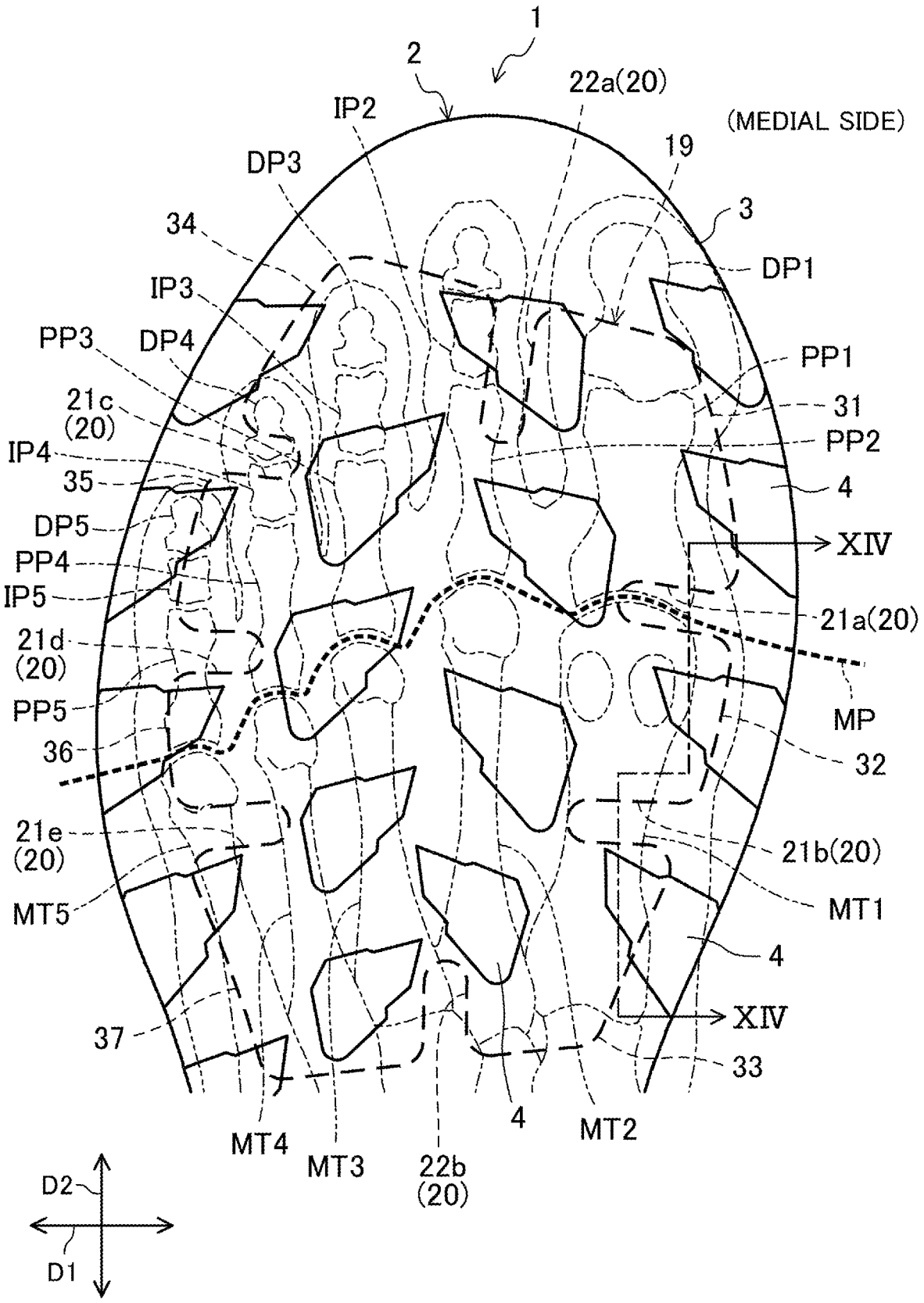
FIG. 10 is a partially enlarged view of part of the sole structure corresponding to the forefoot and midfoot of the wearer's foot, as viewed from below, together with the skeletal structure of the wearer's foot.

As shown in FIGS. 2, 9, and 10, the sole structure 1 includes a plate 19. The plate 19 is a member that increases the rigidity mainly in an area of the sole structure 1 extending from a position corresponding to the forefoot F to a position corresponding to midfoot M of the wearer's foot.

The plate 19 is arranged between the outsole 2 and the midsole 5 (see FIGS. 11 to 14). Specifically, the plate 19 is placed in the lower receiving part 7 of the first midsole 6 and is fixed to the lower receiving part 7 and the upper surface of the outsole body 3 with an adhesive. In FIGS. 11 to 14, the plate 19 is hatched with a dotted pattern to distinguish the plate 19 from the other components.

The plate 19 is arranged in the sole structure 1 to correspond to the forefoot F and midfoot M of the foot of the wearer. Specifically, the plate 19 is arranged in an area of the sole structure 1 extending from a position corresponding to the tiptoe of the wearer's foot to a position corresponding to the center of the arch of the wearer's foot. As shown in FIG. 9, peripheral edges of the plate 19 on the medial side and the lateral side may be curved.

The plate 19 is formed as a thin layer having a higher rigidity than the midsole 5 and the outsole 2. The plate 19 is preferably made of a hard elastic material. Examples of the hard elastic material include thermoplastic resins such as thermoplastic polyurethane (TPU), polyamide elastomer (PAE), and an ABS resin, thermosetting resins such as an epoxy resin and an unsaturated polyester resin, and an ethylene-vinyl acetate copolymer resin (EVA). Also usable is fiber-reinforced plastic (FRP) containing reinforcement fibers such as carbon fibers, aramid fibers, or glass fibers in a matrix resin such as a thermosetting resin or a thermoplastic resin.

(Cuts)

As shown in FIGS. 9 and 10, the plate 19 has a plurality of cuts 20. In this embodiment, the cuts 20 include first cuts 21*a* to 21*e* and second cuts 22*a* and 22*b*.

The first cuts 21*a* to 21*e* are formed to extend from the peripheral edge of the plate 19 in the first direction D1 in the surface direction of the plate 19. Specifically, the first cuts 21*a* to 21*e* extend in a substantially band shape along the foot width direction of the sole structure 1. Each of the first cuts 21*a* to 21*e* is formed to have a substantially arc-shaped tip end. This shape avoids easy concentration of stress on the tip ends of the first cuts 21*a* to 21*e*.

The first cuts 21*a* and 21*b* are formed on the medial side of the plate 19. The first cuts 21*a* and 21*b* are spaced from each other in the second direction D2 (the foot length direction). The first cut 21*a* is arranged in the sole structure 1 to correspond to a joint of the wearer's foot between a proximal head of the first proximal phalanx PP1 and a distal head of the first metatarsal MT1 (i.e., the metacarpophalangeal (MP) joint of the foot indicated by a reference sign "MP" in FIG. 10). The first cut 21*b* is arranged in the sole structure 1 to mainly correspond to the substantial center of the first metatarsal bone MT1 of the wearer's foot in the foot length direction.

The first cuts 21*c*, 21*d*, and 21*e* are formed on the lateral side of the plate 19. The first cuts 21*c*, 21*d*, and 21*e* are arranged at intervals in the second direction D2 (the foot length direction). The first cut 21*c* is arranged in the sole structure 1 to mainly correspond to a joint of the wearer's foot between a proximal head of the fourth distal phalanx DP4 and a distal head of the fourth middle phalanx IP4. The first cut 21*d* is arranged in the sole structure 1 to mainly correspond to a distal head of the fifth proximal phalanx PP5 of the wearer's foot. The first cut 21*e* is arranged in the sole structure 1 close to a position mainly corresponding to a distal head of the fifth metatarsal bone MT5 of the wearer's foot.

The second cuts 22*a* and 22*b* are formed to extend from the peripheral edge of the plate 19 in the second direction D2 in the surface direction of the plate 19. Specifically, the second cuts 22*a* and 22*b* extend in a substantially band shape along the foot length direction of the sole structure 1. Each of the second cuts 22*a* and 22*b* is formed to have a substantially arc-shaped tip end. This shape avoids easy concentration of stress on the tip ends of the second cuts 22*a* and 22*b*.

The second cut 22*a* is formed on the front side (the tiptoe side) of the plate 19. The second cut 22*a* is arranged in the sole structure 1 mainly to be close to the second middle phalanx IP2 and to correspond to a distal head of the second proximal phalanx PP2 of the wearer's foot.

The second cut 22*b* is formed on the rear side (the arch side) of the plate 19. The second cut 22*b* is arranged in the sole structure 1 to mainly correspond to a proximal head of the second metatarsal bone MT2 and a proximal head of the third metatarsal bone MT3 of the wearer's foot.

(Movable Portions)

As shown in FIGS. 9 and 10, the plate 19 has a plurality of movable portions. In this embodiment, the movable portions include movable portions 31 to 37.

Each of the movable portions 31 to 37 is defined by phantom lines (VL1 to VL7 shown in FIG. 9) running along the extending directions of the cuts 20. The movable portions 31 to 37 are configured to be movable independently of each other in the vertical direction (the thickness direction of the sole structure 1).

The movable portion 31 is defined by the phantom line VL1 running along the extending direction of the first cut 21*a* and the phantom line VL6 running along the extending direction of the second cut 22*a*. The movable portion 31 is arranged in the sole structure 1 to mainly correspond to the first distal phalanx DP1 and first proximal phalanx PP1 of the wearer's foot.

The movable portion 32 is defined by the phantom line VL1 running along the extending direction of the first cut 21*a*, the phantom line VL2 running along the extending direction of the first cut 21*b*, and the phantom line VL6 running along the extending direction of the second cut 22*a*. The movable portion 32 is arranged in the sole structure 1 to mainly correspond to the first metatarsal bone MT1 and second metatarsal bone MT2 of the wearer's foot.

The movable portion 33 is defined by the phantom line VL2 running along the extending direction of the first cut 21*b* and the phantom line VL7 running along the extending direction of the second cut 22*b*. The movable portion 33 is arranged in the sole structure 1 to mainly correspond to the first metatarsal bone MT1 and second metatarsal bone MT2 of the wearer's foot.

The movable portion 34 is defined by the phantom line VL3 running along the extending direction of the first cut 21*c* and the phantom line VL6 running along the extending direction of the second cut 22*a*. The movable portion 34 is arranged in the sole structure 1 to mainly correspond to the third distal phalanx DP3, fourth distal phalanx DP4, second middle phalanx IP2, third middle phalanx IP3, and second proximal phalanx PP2 of the wearer's foot.

The movable portion 35 is defined by the phantom line VL3 running along the extending direction of the first cut 21*c*, the phantom line VL4 running along the extending direction of the first cut 21*d*, and the phantom line VL6 running along the extending direction of the second cut 22*a*. The movable portion 35 is arranged in the sole structure 1 to mainly correspond to the fifth distal phalanx DP5, fourth middle phalanx IP4, second to fifth proximal phalanges PP2 to PP5, and second metatarsal MT2 of the wearer's foot.

The movable portion 36 is defined by the phantom line VL4 running along the extending direction of the first cut 21*d*, the phantom line VL5 running along the extending direction of the first cut 21*e*, and the phantom line VL6 running along the extending direction of the second cut 22*a*. The movable portion 36 is arranged in the sole structure 1 to mainly correspond to the fifth proximal phalanx PP5 and third to fifth metatarsal bones MT3 to MT5 of the wearer's foot.

The movable portion 37 is defined by the phantom line VL5 running along the extending direction of the first cut 21*e* and the phantom line VL7 running along the extending direction of the second cut 22*b*. The movable portion 37 is arranged in the sole structure 1 to mainly correspond to the third to fifth metatarsal bones MT3 to MT5 of the wearer's foot.

(Positional Relationship between Movable Portions and Projections)

As shown in FIG. 10, each of the movable portions 31 to 37 is arranged to overlap with some of the projections 4 in the thickness direction of the sole structure 1. The projections 4 are arranged not to overlap with the first cuts 21*a* to 21*e* in a bottom view. Further, the projections 4 are arranged not to overlap with the second cut 22*b* in the bottom view. In FIG. 10, the projections 4 that do not overlap with the movable portions 31 to 37 are not shown to simplify the drawings.

Figure 14:
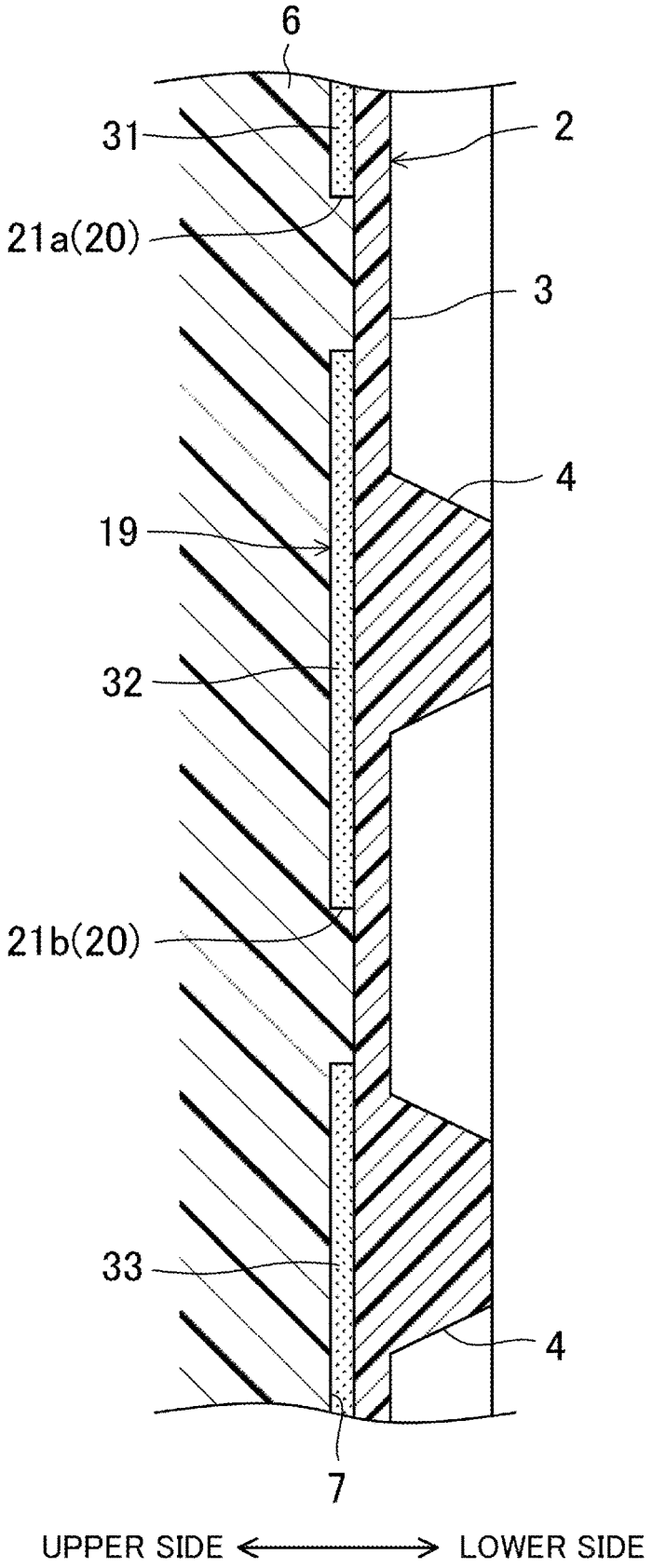
FIG. 14 is a cross-sectional view taken along the line XIV-XIV shown in FIG. 10.

As shown in FIGS. 10 and 14, in an area of the sole structure 1 corresponding to the forefoot of the wearer's foot, the projections 4 on the medial side are arranged to overlap with the movable portions 32 and 33 in the thickness direction of the sole structure 1. The projections 4 on the medial side are arranged at intervals not to overlap with the first cut 21*a* and the second cut 21*b*.

[Advantages of Embodiment]

As described above, the plate 19 arranged between the outsole 2 and the midsole 5 of the sole structure 1 increases the rigidity of the sole structure 1. This can stably support the wearer's foot. In the sole structure 1, the rigidity of the plate 19 can reduce the impact pushing up the foot when the foot touches the ground.

The plate 19 includes the cuts 20 and the movable portions 31 to 37 defined by the phantom lines running along the extending directions of the cuts 20. The cuts 20 formed in the plate 19 lower the rigidity of the plate 19 locally at the phantom lines running along the extending directions of the cuts 20. Thus, the plate 19 easily bends along the phantom lines. For example, when the impact pushing up the foot (an external pressure in the vertical direction) is applied to any of the movable portions 31 to 37, the plate 19 bends along the phantom lines defining the movable portion.

The movable portions 31 to 37 are configured to be movable independently of each other in the vertical direction (the thickness direction of the sole structure 1). This configuration avoids loss of the bendability of the sole structure 1. Thus, the movements of the joints of the wearer's foot are less likely to be restricted, allowing each of the movable portions 31 to 37 to follow the flexible movements of the wearer's foot. This reduces a load applied to the joints of the wearer's foot during, for example, trail running that takes relatively long race time, keeping the wearer's foot from hurting. Further, this configuration ensures that the movable portions 31 to 37 have the same rigidity as the plate 19, allowing the movable portions 31 to 37 to reduce the impact pushing up the foot when the foot touches the ground.

Thus, the sole structure 1 of the embodiment of the present disclosure can ensure the rigidity without loss of the bendability.

The cuts 20 include the first cuts 21*a* to 21*e* extending along the first direction D1 and the second cuts 22*a* and 22*b* extending along the second direction D2. This configuration can subdivide the movable portions into, for example, the movable portions 31 to 37 shown in FIG. 9. This can further enhance the ability of the sole structure to follow the flexible movements of the foot of the wearer.

The midsole 5 may have the grooves 12 formed in the upper surface of the midsole 5. The grooves 12 include the first grooves 13 extending along the first direction D1 and the second grooves 14 extending along the second direction D2. Specifically, each of the first grooves 13 extends along the same direction as the extending direction of the first cuts 21*a* to 21*e*, and each of the second grooves 14 extends along the same direction as the extending direction of the second cuts 22*a* and 22*b*. This configuration allows the midsole 5 to bend in accordance with the movements of the movable portions 31 to 37. This can avoid loss of the bendability of the sole structure 1.

As described in this embodiment, the first direction D1 may extend along the foot width direction of the sole structure 1, and the second direction D2 may extend along the foot length direction of the sole structure 1. That is, in this embodiment, the first cuts 21*a* to 21*e* and the first grooves 13 extend along the foot width direction, and the second cuts 22*a* and 22*b* and the second grooves 14 extend along the foot length direction. This configuration allows the plate 19 and the midsole 5 to bend in the foot width direction and the foot length direction.

Each of the movable portions 31 to 37 is arranged to overlap with some of the projections 4 in the thickness direction of the sole structure 1. This configuration allows each of the projections 4 to easily move in the vertical direction following the bending movements of the plate 19 along the phantom lines. Thus, the projections 4 do not interfere with the movements of the movable portions 31 to 37 and can give improved traction to the outsole 2.

Further, the projections 4 are arranged not to overlap with the first cuts 21*a* to 21*e* in the bottom view. This configuration keeps the projections 4 from interfering with the bending movements of the plate 19 starting from the phantom lines VL1 to VL5. This does not block the vertical movements of the movable portions 31 to 37, allowing the movable portions 31 to 37 to easily follow the flexible movements of the wearer's foot. Thus, the embodiment of the present disclosure can avoid loss of the bendability of the sole structure 1.

The projections 4 near the center of the arch may be arranged not to overlap with the second cut 22*b*. Thus, the projections 4 near the center of the arch do not interfere with the bending movements of the plate 19 starting from the phantom line VL7. This does not block the vertical movements of the movable portions 33 and 37 in particular, allowing the movable portions 33 and 37 to easily follow the flexible movements of the wearer's foot.

Preferably, the plate 19 is arranged in an area of the sole structure 1 extending from a position corresponding to the tiptoe of the wearer's foot to a position corresponding to the center of the arch of the wearer's foot. Likewise, the grooves 12 are preferably arranged in an area of the midsole 5 extending from a position corresponding to the tiptoe of the wearer's foot to a position corresponding to the center of the arch of the wearer's foot. This configuration can avoid loss of the bendability of the area of the sole structure 1 extending from the position corresponding to the tiptoe of the wearer's foot to the position corresponding to the center of the arch of the wearer's foot. In general, MP joints are present in an area of a human foot structure extending from the tiptoe to the center of the arch. Thus, the plate 19 and the grooves 12 arranged as described above can reduce the load on the MP joints of the foot of the wearer. This configuration is less likely to hurt the wearer's foot during, for example, trail running that takes relatively long race time.

[Other Embodiments]

It has been described in the embodiment that the plate 19 is arranged in the lower receiving part 7 of the first midsole 6, but the plate 19 is not limited to this embodiment. For example, the plate 19 may be arranged in a receiving part (not shown) formed in the upper surface of the outsole 2. Alternatively, the plate 19 may be arranged between the upper surface of the outsole 2 and the lower surface of the first midsole 6 without providing the lower receiving part 7 in the first midsole 6.

It has been described in the embodiment that the grooves 12 include the first grooves 13 and the second grooves 14, but the grooves 12 are not limited to this embodiment. For example, the grooves 12 may include the first grooves 13 alone (or at least one first groove 13 alone). Alternatively, the grooves 12 may include the second grooves 14 alone (or at least one second groove 14 alone).

It has been described in the embodiment that the cuts 20 include the first cuts 21*a* to 21*e* and the second cuts 22*a* and 22*b*, but the cuts 20 are not limited to this embodiment. For example, the cuts 20 may include the first cuts 21*a* to 21*e* alone (or only one of the first cuts 21*a* to 21*e*). Alternatively, the cuts 20 may include the second cuts 22*a* and 22*b* alone (or only one of the second cuts 22*a* and 22*b*). That is, if the plate 19 has the first cuts 21*a* to 21*e* or the second cuts 22*a* and 22*b*, the multiple movable portions can be provided.

It has been described in the embodiment that the projections 4 are arranged not to overlap with the cuts 20 in the vertical direction, but the projections 4 are not limited to this embodiment. Specifically, each of the projections 4 may partially overlap with any of the cuts 20.

It has been described in the embodiment that the "first direction D1" corresponds to the foot width direction of the sole structure 1, and the "second direction D2" corresponds to the foot length direction of the sole structure 1. However, the first and second directions are not limited to this embodiment. Specifically, each of the "first direction D1" and the "second direction D2" may be a direction intersecting with each of the foot width direction and the foot length direction.

Figure 13:
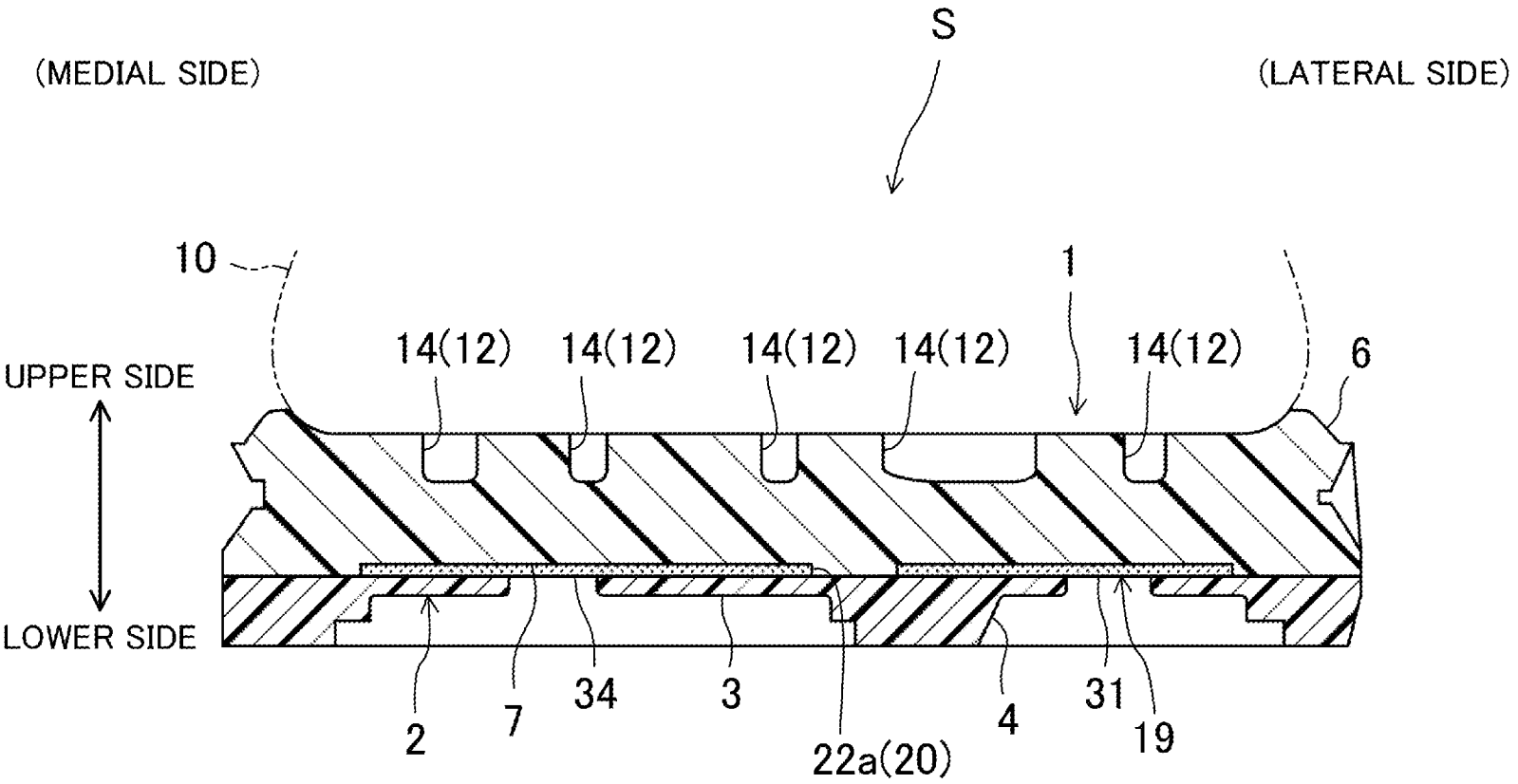
FIG. 13 is a cross-sectional view taken along line XIII-XIII shown in FIG. 3.
Figure 15:
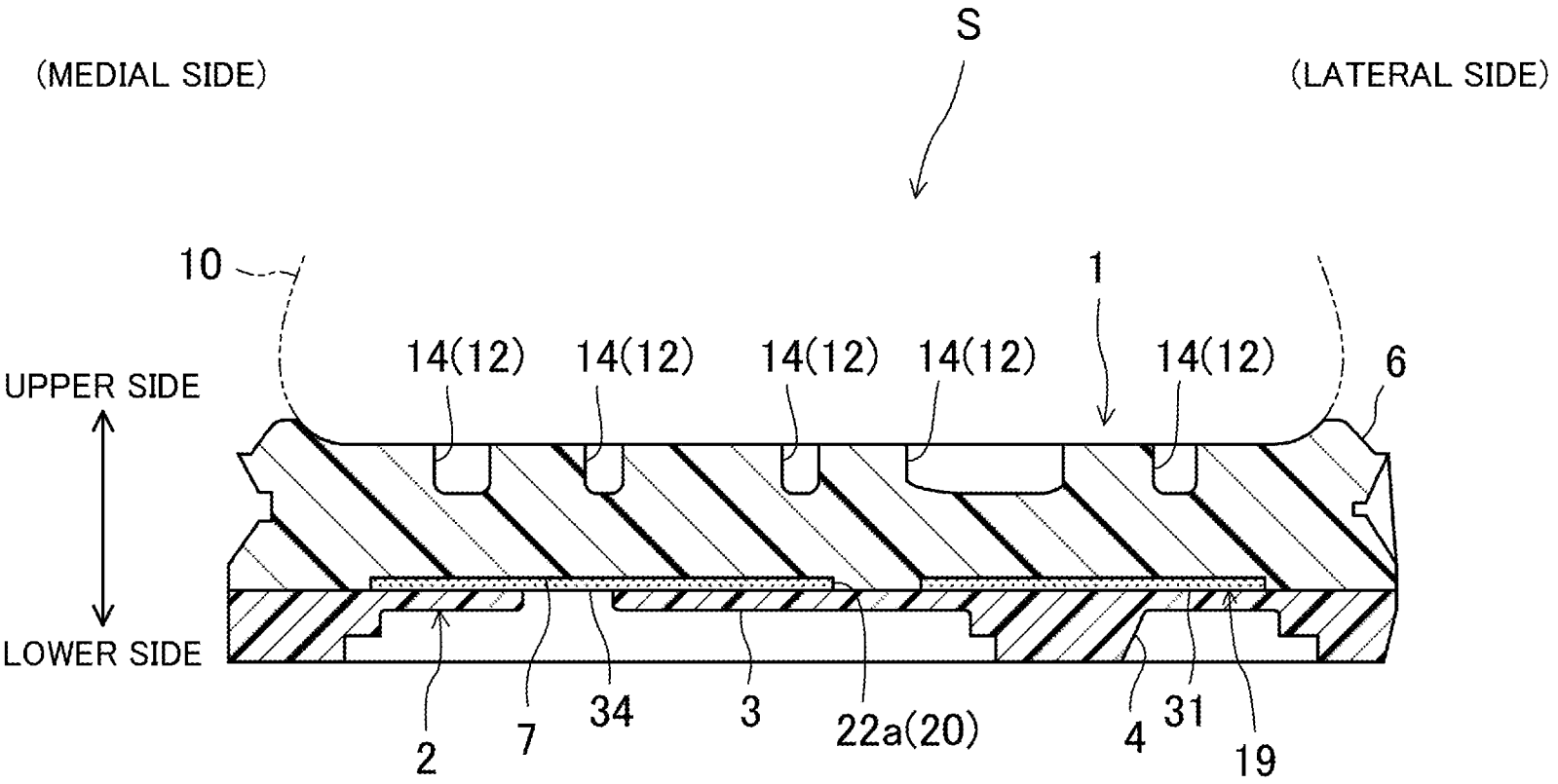
FIG. 15 is a view corresponding to FIG. 13, showing another embodiment in which a projection and a second cut are arranged not to overlap with each other in the vertical direction.

It has been described in the embodiment that the projection 4 on the tiptoe side and the second cut 22*a* overlap with each other in the vertical direction in FIG. 13, but the projection 4 on the tiptoe side and the second cut 22*a* may be arranged not to overlap with each other in the vertical direction as shown in FIG. 15. When the projection 4 on the tiptoe side is arranged as shown in FIG. 15, the projection 4 does not interfere with the bending movements of the plate 19 starting from the phantom line VL6. This does not block the vertical movements of the movable portions 31 and 34 in particular, allowing the movable portions 31 and 34 to easily follow the flexible movements of the wearer's foot.

Although the embodiments of the present disclosure have been described above, the present disclosure is not limited to the above embodiments, and various modifications can be made within the scope of the present disclosure.

The present disclosure can be industrially applicable as a sole structure of a shoe suitable for trail running, for example, and a shoe including the same.

What is claimed is:

1. A sole structure of a shoe, comprising:

an outsole;

a midsole stacked on an upper side of the outsole; and a plate that is arranged between the outsole and the midsole and is made of a material having a higher rigidity than the outsole and the midsole, the plate including:

a plurality of cuts formed to extend from a peripheral edge of the plate in a first direction or a second direction intersecting with the first direction; and a plurality of movable portions defined by phantom lines running along extending directions of the plurality of cuts, the plurality of movable portions being configured to be movable independently of each other in a thickness direction of the sole structure, wherein the first direction corresponds to a foot width direction of the sole structure, while the second direction corresponds to a foot length direction of the sole structure, a front portion of the peripheral edge of the plate is arranged, in the sole structure, at a position configured to correspond to a tiptoe of a wearer's foot in the second direction, a rear portion of the peripheral edge of the plate is arranged, in the sole structure, at a position configured to correspond to a center of an arch of the wearer's foot in the second direction, the plurality of cuts include:

a plurality of first cuts extending in the first direction; and a plurality of second cuts extending in the second direction, the plurality of first cuts include:

one set of first cuts disposed on a medial side of the plate; and another set of first cuts disposed on a lateral side of the plate, the plurality of second cuts include:

at least one second cut disposed at a central portion in the foot width direction in a front portion of the plate; and at least one second cut disposed at a central portion in the foot width direction in a rear portion of the plate, the at least one second cut in the front portion of the plate and the at least one second cut in the rear portion of the plate are opposed to each other in the second direction.

2. The sole structure of claim 1, wherein the at least one second cut in the front portion of the plate and the at least one second cut in the rear portion of the plate are disposed, in the first direction, between: ends of the one set of first cuts disposed on the medial side of the plate; and ends of the other set of first cuts disposed on the lateral side of the plate.

3. The sole structure of claim 1, wherein the midsole has a plurality of grooves formed in an upper surface of the midsole, and each of the plurality of grooves extends along the first direction or the second direction.

4. The sole structure of claim 3, wherein the plurality of grooves include:

at least one first groove extending in the first direction; and at least one second groove extending in the second direction.

5. The sole structure of claim 1, wherein the outsole includes:

an outsole body; and a plurality of projections projecting downward from the outsole body, and each of the plurality of movable portions is arranged to overlap with any of the plurality of projections in a thickness direction of the sole structure.

6. The sole structure of claim 5, wherein each of the plurality of projections is arranged not to overlap with the first cut in a bottom view.

7. The sole structure of claim 1, wherein the plate is arranged in an area of the sole structure extending from the position configured to correspond to the tiptoe of the wearer's foot to the position configured to correspond to the center of the arch of the wearer's foot.

8. The sole structure of claim 1, wherein the plurality of grooves are arranged in an area of the midsole extending from a position configured to correspond to the tiptoe of the wearer's foot to the position configured to correspond to the center of the arch of the wearer's foot.

9. A shoe comprising the sole structure of claim 1.

10. A shoe comprising the sole structure of claim 2.

11. A shoe comprising the sole structure of claim 3.

12. A shoe comprising the sole structure of claim 4.

13. A shoe comprising the sole structure of claim 5.

14. A shoe comprising the sole structure of claim 6.

15. A shoe comprising the sole structure of claim 7.

16. A shoe comprising the sole structure of claim 8.

* * * * *